US011854499B2

(12) United States Patent
Pyun et al.

(10) Patent No.: US 11,854,499 B2
(45) Date of Patent: Dec. 26, 2023

(54) CONTROLLER, DISPLAY DEVICE INCLUDING THE SAME, AND METHOD OF DRIVING DISPLAY DEVICE USING THE SAME

(71) Applicant: Samsung Display Co., Ltd., Yongin-Si (KR)

(72) Inventors: Kihyun Pyun, Gwangmyeong-si (KR); Kyoungho Lim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 18/088,715

(22) Filed: Dec. 26, 2022

(65) Prior Publication Data

US 2023/0368743 A1 Nov. 16, 2023

(30) Foreign Application Priority Data

May 12, 2022 (KR) ..... 10-2022-0058334

(51) Int. Cl.
*G09G 3/3291* (2016.01)
*G09G 3/32* (2016.01)
*G09G 3/36* (2006.01)

(52) U.S. Cl.
CPC ..... *G09G 3/3291* (2013.01); *G09G 3/32* (2013.01); *G09G 3/3688* (2013.01);
(Continued)

(58) Field of Classification Search
CPC ... G09G 2320/0673; G09G 2320/0626; G09G 2320/0233; G09G 2320/0285;
(Continued)

(56) References Cited

U.S. PATENT DOCUMENTS

2006/0170619 A1* 8/2006 Terai ..... G09G 3/2051 345/63
2006/0202632 A1* 9/2006 Hara ..... G09G 3/3283 315/169.3

(Continued)

FOREIGN PATENT DOCUMENTS

KR 10-0420032 B1 2/2004
KR 10-1263533 B1 5/2013

(Continued)

*Primary Examiner* — Dong Hui Liang
(74) *Attorney, Agent, or Firm* — Innovation Counsel LLP

(57) ABSTRACT

A display device is disclosed that includes a display panel, a controller, and a data driver. The controller is configured to determine first luminances with respect to a reference grayscale in a second frame when the reference grayscale is displayed in the second frame after the reference grayscale is displayed in a first frame. The controller is configured to determine second luminances with respect to the reference grayscale in the second frame when the reference grayscale is displayed in the second frame after a minimum grayscale is displayed in the first frame. The controller is further configured to temporally and spatially arrange first data corresponding to the reference grayscale and second data corresponding to the minimum grayscale to generate a data signal. And, the controller is configured to drive the display panel with a digital driving method in a first grayscale section, and drive the display panel with an analog driving method in a second grayscale section. The data driver is configured to generate a data voltage based on the data signal.

20 Claims, 12 Drawing Sheets

(52) U.S. Cl.
CPC ..... *G09G 2310/027* (2013.01); *G09G 2320/0276* (2013.01); *G09G 2320/0673* (2013.01); *G09G 2360/16* (2013.01)

(58) Field of Classification Search
CPC ... G09G 2320/0646; G09G 2320/0653; G09G 2360/16; G09G 3/3406; G09G 3/2007
See application file for complete search history.

(56) References Cited

U.S. PATENT DOCUMENTS

| | | | | |
|---|---|---|---|---|
| 2008/0272998 | A1* | 11/2008 | Yano | G09G 3/2051 345/89 |
| 2016/0027390 | A1* | 1/2016 | Kim | G09G 3/3607 345/694 |
| 2016/0247483 | A1* | 8/2016 | Jang | G09G 3/3648 |
| 2021/0375181 | A1* | 12/2021 | Pyun | G09G 3/2077 |

FOREIGN PATENT DOCUMENTS

| | | | |
|---|---|---|---|
| KR | 10-1350398 | B1 | 1/2014 |
| KR | 10-1597037 | B1 | 2/2016 |

* cited by examiner

CONTROLLER, DISPLAY DEVICE INCLUDING THE SAME, AND METHOD OF DRIVING DISPLAY DEVICE USING THE SAME

CROSS-REFERENCE TO RELATED APPLICATION(S)

This application claims priority under 35 USC § 119 to Korean Patent Application No. 10-2022-0058334 filed on May 12, 2022, in the Korean Intellectual Property Office (KIPO), the entire disclosure of which is incorporated by reference herein.

BACKGROUND

1. Field

The present disclosure relates to a display device.

2. Description of the Related Art

A display device includes a display panel and a controller. The display panel displays an image based on input data including a plurality of frame data. The controller drives of the display panel.

Depending on the characteristics of the display panel, gamma values of the image may be non-uniform in a low grayscale section, color coordinates of the image may be non-uniform in the low grayscale section, and unevenness of the image may be recognized in the low grayscale section.

SUMMARY

Embodiments may provide a controller for a display device to accurately display a luminance with respect to an input grayscale.

Embodiments may provide a display device including the controller and a method of driving a display device using the controller.

A display device according to embodiments may include a display panel including at least one block including a plurality of pixels, a controller configured to: determine first luminances with respect to a reference grayscale in a second frame after a first frame when the reference grayscale is displayed in the second frame after the reference grayscale is displayed in the first frame; determine second luminances with respect to the reference grayscale in the second frame when the reference grayscale is displayed in the second frame after a minimum grayscale is displayed in the first frame; temporally and spatially arrange first data corresponding to the reference grayscale and second data corresponding to the minimum grayscale based on an input grayscale, a gamma value, the first luminances, and the second luminances to generate a data signal; drive the display panel with a digital driving method using the first data and the second data in a first grayscale section less than or equal to the reference grayscale; and drive the display panel with an analog driving method in a second grayscale section greater than the reference grayscale; and a data driver configured to generate a data voltage based on the data signal and outputting the data voltage to the display panel.

In an embodiment, a number of the pixels to which the first data is inputted in the second frame may be less than or equal to a number of the pixels to which the first data is inputted in the first frame.

In an embodiment, the first data may be inputted in the second frame to at least one of the pixels to which the second data is inputted in the first frame.

In an embodiment, a number of the pixels to which the first data is inputted in a third frame after the second frame may be equal to a number of the pixels to which the first data is inputted in the second frame.

In an embodiment, each of a luminance of the block in the second frame and a luminance of the block in the third frame may be equal to a luminance of the block in the first frame.

In an embodiment, a number of the pixels to which the first data is inputted in a third frame after the second frame may be different from a number of the pixels to which the first data is inputted in the second frame.

In an embodiment, an average of a luminance of the block in the second frame and a luminance of the block in the third frame may be equal to a luminance of the block in the first frame.

In an embodiment, the display device may further include a scan driver configured to outputting a first scan signal and a second scan signal to the display panel.

In an embodiment, each of the pixels may include a first transistor connected between a first power line transmitting a first power voltage and a first node, a second transistor connected between a data line transmitting the data voltage and a gate electrode of the first transistor, and including a gate electrode connected to a first scan line transmitting the first scan signal, a third transistor connected between an initialization line transmitting an initialization voltage and the first node, and including a gate electrode connected to a second scan line transmitting the second scan signal, a storage capacitor connected between the gate electrode of the first transistor and the first node, and a light emitting element connected between the first node and a second power line transmitting a second power voltage.

A controller according to embodiments may include a first luminance determiner configured to determine first luminances with respect to a reference grayscale in a second frame after a first frame when the reference grayscale is displayed in the second frame after the reference grayscale is displayed in the first frame, a second luminance determiner configured to determine second luminances with respect to the reference grayscale in the second frame when the reference grayscale is displayed in the second frame after a minimum grayscale is displayed in the first frame, and a time-and-space arranger configured to temporally and spatially arranging first data corresponding to the reference grayscale and second data corresponding to the minimum grayscale based on an input grayscale, a gamma value, the first luminances, and the second luminances. The controller may drive a display panel including at least one block including a plurality of pixels with a digital driving method using the first data and the second data in a first grayscale section less than or equal to the reference grayscale, and may drive the display panel with an analog driving method in a second grayscale section greater than the reference grayscale.

In an embodiment, a number of the pixels to which the first data is inputted in the second frame may be less than or equal to a number of the pixels to which the first data is inputted in the first frame.

In an embodiment, the first data may be inputted in the second frame to at least one of the pixels to which the second data is inputted in the first frame.

In an embodiment, a number of the pixels to which the first data is inputted in a third frame after the second frame may be equal to a number of the pixels to which the first data is inputted in the second frame.

In an embodiment, each of a luminance of the block in the second frame and a luminance of the block in the third frame may be equal to a luminance of the block in the first frame.

In an embodiment, a number of the pixels to which the first data is inputted in a third frame after the second frame may be different from a number of the pixels to which the first data is inputted in the second frame.

In an embodiment, an average of a luminance of the block in the second frame and a luminance of the block in the third frame may be equal to a luminance of the block in the first frame.

In an embodiment, the controller may further include a luminance increase rate determiner configured to store luminance increase rates of grayscales to the minimum grayscale.

In an embodiment, each of the first luminance determiner, the second luminance determiner, and the luminance increase rate determiner may include a look-up table.

A method of driving a display device including at least one block including a plurality of pixels according to embodiments may include determining first luminances with respect to a reference grayscale in a second frame after a first frame when the reference grayscale is displayed in the second frame after the reference grayscale is displayed in the first frame, determining second luminances with respect to the reference grayscale in the second frame when the reference grayscale is displayed in the second frame after a minimum grayscale is displayed in the first frame, temporally and spatially arranging first data corresponding to the reference grayscale and second data corresponding to the minimum grayscale based on an input grayscale, a gamma value, the first luminances, and the second luminances to generate a data signal, and generating a data voltage based on the data signal.

In an embodiment, a number of the pixels to which the first data is inputted in the second frame may be less than or equal to a number of the pixels to which the first data is inputted in the first frame.

In the controller, the display device, and the method of driving the display device according to the embodiments, in the first grayscale section, the first data corresponding to the reference grayscale and the second data corresponding to the minimum grayscale may be temporally and spatially arranged based on the first luminances, which indicates luminances with respect to the reference grayscale when the reference grayscale is displayed after the reference grayscale is displayed, and the second luminances, which indicates luminances with respect to the reference grayscale when the reference grayscale is displayed after the minimum grayscale is displayed, to generate the data signal, so that a luminance with respect to an input grayscale may be accurately displayed.

BRIEF DESCRIPTION OF THE DRAWINGS

Illustrative, non-limiting embodiments will be more clearly understood from the following detailed description taken in conjunction with the accompanying drawings.

DETAILED DESCRIPTION OF THE EMBODIMENTS

Figure 1:
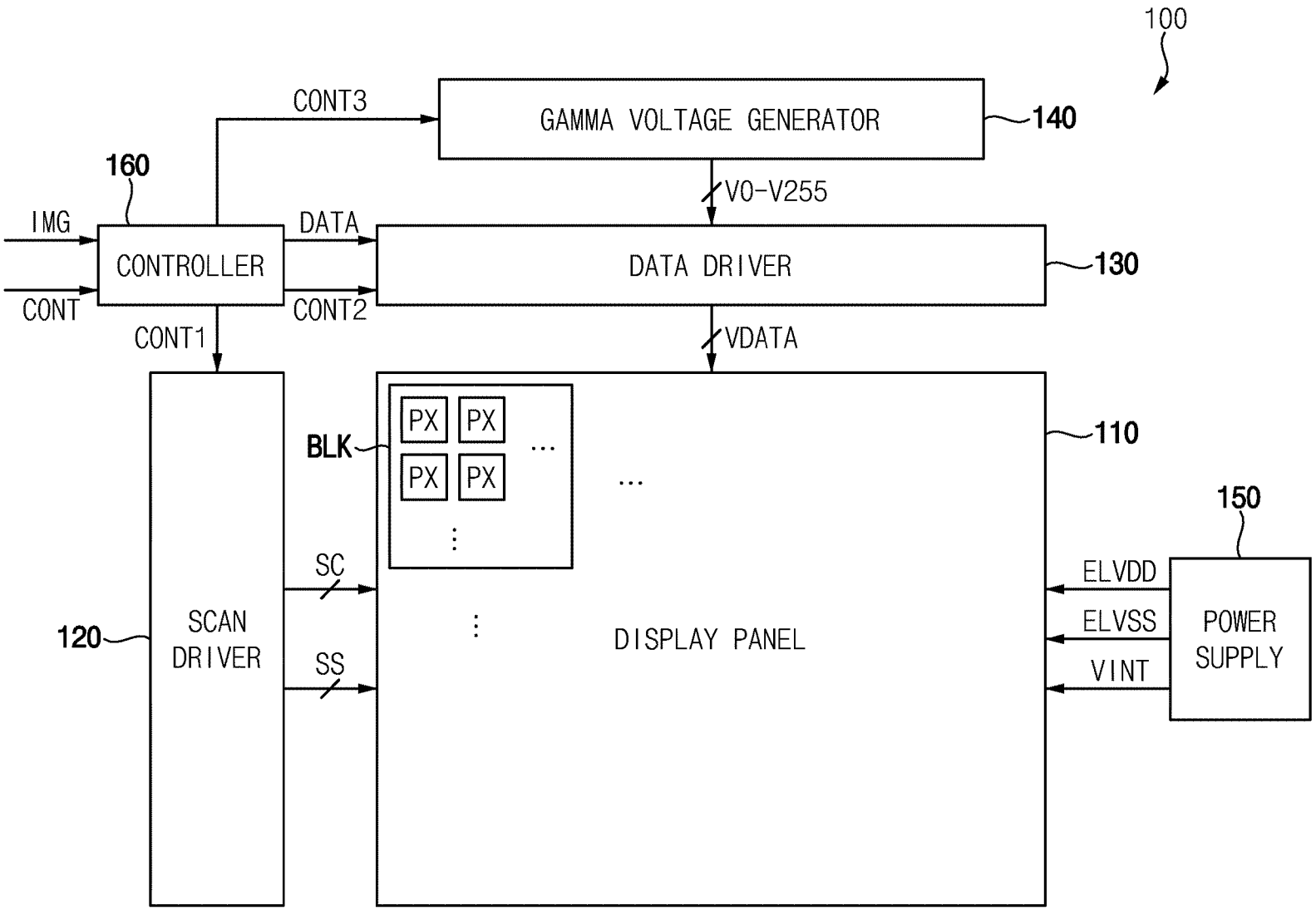
FIG. 1 is a block diagram illustrating a display device according to an embodiment.

Hereinafter, a display device, a controller, and a method of driving a display device according to embodiments will be described in more detail with reference to the accompanying drawings. The same or similar reference numerals will be used for the same elements in the accompanying drawings.

FIG. 1 is a block diagram illustrating a display device 100 according to an embodiment.

Referring to FIG. 1, the display device 100 may include a display panel 110, a scan driver 120, a data driver 130, a gamma voltage generator 140, a power supply 150, and a controller 160.

The display panel 110 may display an image. The display panel 110 may include various display elements such as an organic light emitting diode ("OLED") or the like. Hereinafter, the display device 100 including the organic light emitting diode as a display element will be described for convenience. However, the present disclosure is not limited thereto, and the display device 100 may include various display elements such as a liquid crystal display ("LCD") element, an electrophoretic display ("EPD") element, and an inorganic light emitting diode, or the like.

The display panel 110 may include a plurality of pixels PX. Each of the pixels PX may be electrically connected to a data line DL in FIG. 2 and scan lines SL1 and SL2 in FIG. 2. Further, each of the pixels PX may be electrically connected to a first power line PL1 in FIG. 2 and a second power line PL2 in FIG. 2, and may receive a first power voltage ELVDD and a second power voltage ELVSS from the first power line PL1 and the second power line PL2, respectively.

Each of the pixels PX may emit light having a luminance corresponding to a data voltage VDATA provided through the data line DL in response to scan signals SC and SS provided through the scan lines SL1 and SL2. The configuration and operation of the pixel PX will be described with reference to FIGS. 2 to 4.

The display panel 110 may be divided into a plurality of blocks BLK. Each of the blocks BLK may include a plurality of pixels PX. When the display panel 110 is driven with a digital driving method, each of the blocks BLK may represent an input grayscale.

The scan driver 120 (or a gate driver) may generate the first scan signal SC (or a first gate signal) and the second scan signal SS (or a second gate signal) based on a first control signal CONT1, and may provide the first scan signal SC and the second scan signal SS to the first scan line SL1 and the second scan line SL2, respectively. The first control signal CONT1 may include a start signal, a clock signal, or the like. For example, the scan driver 120 may sequentially generate and output the first scan signal SC and the second scan signal SS corresponding to the start signal using the clock signal. The scan driver 120 may be implemented as a shift register, but is not limited thereto. In an embodiment, the scan driver 120 may be formed on the display panel 110. In another embodiment, the scan driver 120 may be implemented as an integrated circuit and mounted on a flexible circuit board that is connected to the display panel 110.

The data driver 130 may generate the data voltage VDATA based on a data signal DATA, a second control signal CONT2, and gamma voltages V0 to V255, and may provide the data voltage VDATA to the data line DL. The second control signal CONT2 may include a load signal, a start signal, a clock signal, or the like. In an embodiment, the data driver 130 may be implemented as an integrated circuit (e.g., a driver IC) and mounted on a flexible circuit board that is connected to the display panel 110.

The gamma voltage generator 140 (or a grayscale voltage generator) may generate a plurality of gamma voltages V0 to V255 with respect to a plurality of grayscales based on a third control signal CONT3, and may provide the gamma voltages V0 to V255 to the data driver 130.

Hereinafter, for convenience of description, it will be described that a total of 256 grayscales exist from 0 grayscale (a minimum grayscale) to 255 grayscale (a maximum grayscale), but more grayscales may exist. For example, a total of 256 grayscales may exist when image data IMG has 8 bits, and a total of 512 grayscales may exist when the image data IMG has 9 bits. Here, the minimum grayscale may be the darkest grayscale, and the maximum grayscale may be the brightest grayscale.

The power supply 150 may provide the first power voltage ELVDD, the second power voltage ELVSS, and an initialization voltage VINT to the display panel 110. A voltage level of the first power voltage ELVDD may be higher than a voltage level of the second power voltage ELVSS.

The controller 160 may receive the image data IMG and an input control signal CONT from an external device (e.g., a graphic processor). The image data IMG may include grayscale values corresponding to the pixels PX. The input control signal CONT may include a vertical synchronization signal, a horizontal synchronization signal, a main clock signal, a data enable signal, or the like.

The controller 160 may generate the data signal DATA based on the image data IMG, and may generate the first control signal CONT1, the second control signal CONT2, and the third control signal CONT3 based on the input control signal CONT. The controller 160 may provide the first control signal CONT1 to the scan driver 120, may provide the second control signal CONT2 and the data signal DATA to the data driver 130, and may provide the third control signal CONT3 to the gamma voltage generator 140.

FIG. 1 illustrates that the controller 160 is implemented independently of the data driver 130, but the present disclosure is not limited thereto. For example, the controller 160 may be implemented as a single integrated circuit together with the data driver 130.

The configuration and operation of the controller 160 will be described with reference to FIGS. 6 to 10.

Further, FIG. 1 illustrates that the gamma voltage generator 140 is implemented independently of the data driver 130 or the controller 160, but the present disclosure is not limited thereto. For example, the gamma voltage generator 140 may be implemented as a single integrated circuit together with the data driver 130 or the controller 160, or may be included in the data driver 130 or the controller 160 and implemented in software.

Figure 2:
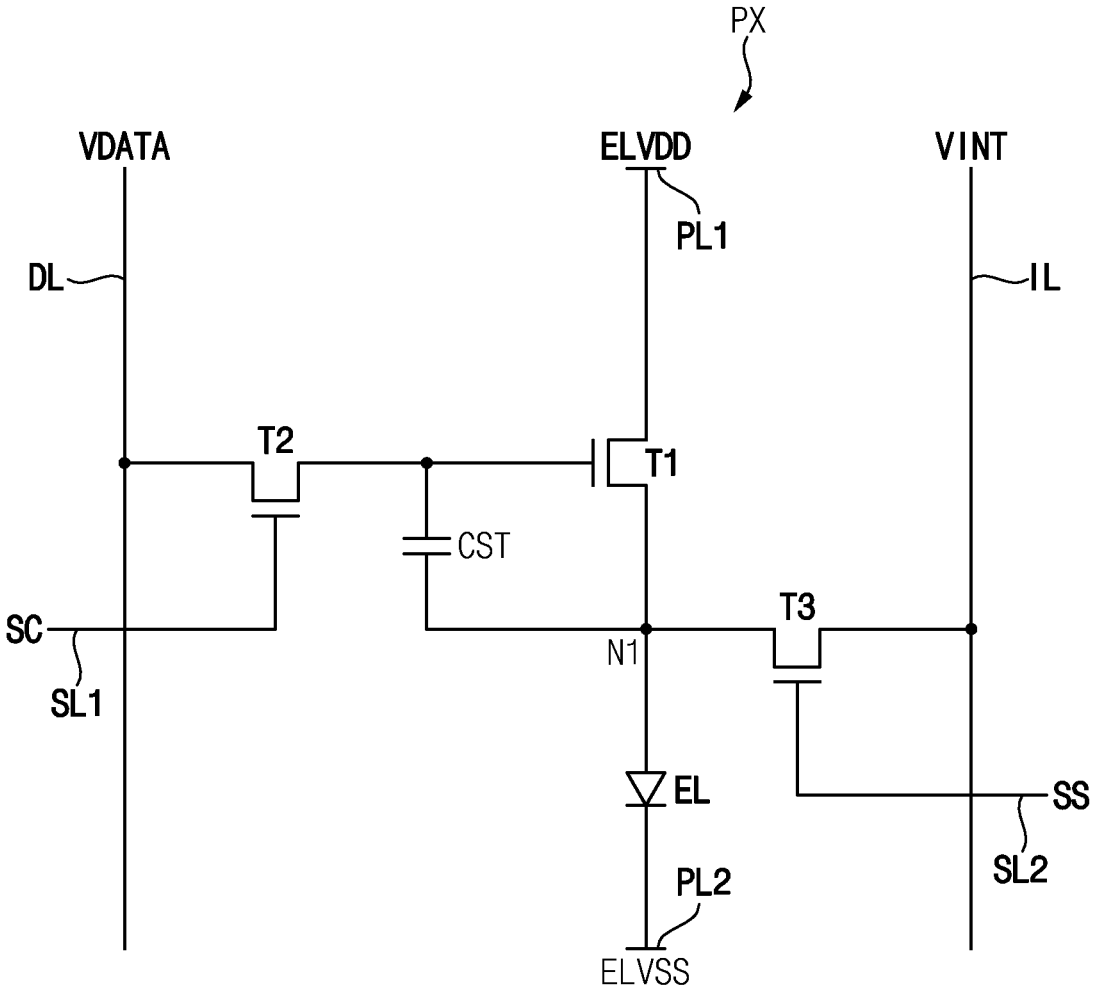
FIG. 2 is a circuit diagram illustrating a pixel included in the display device in FIG. 1.

FIG. 2 is a circuit diagram illustrating the pixel PX included in the display device 100 in FIG. 1.

Referring to FIGS. 1 and 2, in an embodiment, the pixel PX may include a first transistor T1, a second transistor T2, a third transistor T3, a storage capacitor CST, and a light emitting element EL.

The first transistor T1 may be connected between the first power line PL1 transmitting the first power voltage ELVDD and a first node N1. A first electrode (e.g., a source electrode) of the first transistor T1 may be connected to the first power line PL1, and a second electrode (e.g., a drain electrode) of the first transistor T1 may be connected to the first node N1. The first transistor T1 may be referred to as a driving transistor.

The second transistor T2 may be connected between the data line DL transmitting the data voltage VDATA and a gate electrode of the first transistor T1. A first electrode (e.g., a source electrode) of the second transistor T2 may be connected to the data line DL, and a second electrode (e.g., a drain electrode) of the second transistor T2 may be connected to the gate electrode of the transistor T1. A gate electrode of the second transistor T2 may be connected to the first scan line SL1 transmitting the first scan signal SC. The second transistor T2 may be referred to as a switching transistor or a scan transistor.

The third transistor T3 may be connected between an initialization line IL transmitting the initialization voltage VINT and the first node N1. A first electrode (e.g., a source electrode) of the third transistor T3 may be connected to the initialization line IL, and a second electrode (e.g., a drain electrode) of the third transistor T3 may be connected to the first node N1. A gate electrode of the third transistor T3 may be connected to the second scan line SL2 transmitting the second scan signal SS. The third transistor T3 may be referred to as an initialization transistor or a sensing transistor.

In an embodiment, as illustrated in FIG. 2, each of the first transistor T1, the second transistor T2, and the third transistor T3 may be an N-type transistor. In another embodiment, at least one of the first transistor T1, the second transistor T2, and the third transistor T3 may be a P-type transistor.

The storage capacitor CST may be connected between the gate electrode of the first transistor T1 and the first node N1. A first electrode of the storage capacitor CST may be connected to the gate electrode of the first transistor T1, and a second electrode of the storage capacitor CST may be connected to the first node N1.

The light emitting element EL may be connected between the first node N1 and the second power line PL2 transmitting the second power voltage ELVSS. A first electrode (e.g., an anode electrode) of the light emitting element EL may be connected to the first node N1, and a second electrode (e.g., a cathode electrode) of the light emitting element EL may be connected to the second power line PL2. In an embodiment, the light emitting element EL may be an organic light emitting diode. In another embodiment, the light emitting element EL may be an inorganic light emitting diode or a quantum dot light emitting diode.

First, when the second scan signal SS having a turn-on level (e.g., a high level) is applied to the second scan line SL2, the third transistor T3 may be turned on. In this case, the initialization voltage VINT applied to the initialization line IL may be transmitted to the first node N1, and the first electrode of the light emitting element EL may be initialized.

Then, when the first scan signal SC having a turn-on level (e.g., high level) is applied to the first scan line SL1, the second transistor T2 may be turned on. In this case, the data voltage VDATA applied to the data line DL may be transmitted to the gate electrode of the first transistor T1, and the data voltage VDATA may be stored in the storage capacitor CST.

A driving current corresponding to a voltage difference between the gate electrode and the second electrode of the first transistor T1 (or between the first electrode and the second electrode of the storage capacitor CST) may flow between the first electrode and the second electrode of the first transistor T1. The light emitting element EL may emit light with a luminance corresponding to the driving current applied from the first transistor T1.

Then, when the first scan signal SC and the second scan signal SS each having a turn-off level (e.g., a low level) are respectively applied to the first scan line SL1 and the second scan line SL2, the second transistor T2 and the third transistor T3 may be turned off. Accordingly, the data line DL and the first electrode of the storage capacitor CST may be electrically separated, the initialization line IL and the second electrode of the storage capacitor CST may be electrically separated, and the voltage stored in the storage capacitor CST may not change although the data voltage VDATA and the initialization voltage VINT change.

FIG. 2 illustrates an embodiment in which the pixel PX includes three transistors and one capacitor, but the present disclosure is not limited thereto. In another embodiment, the pixel PX may further include an emission control transistor that is turned on in response to an emission control signal to electrically connect the second electrode of the first transistor T1 and the first electrode of the light emitting element EL.

Figure 3:
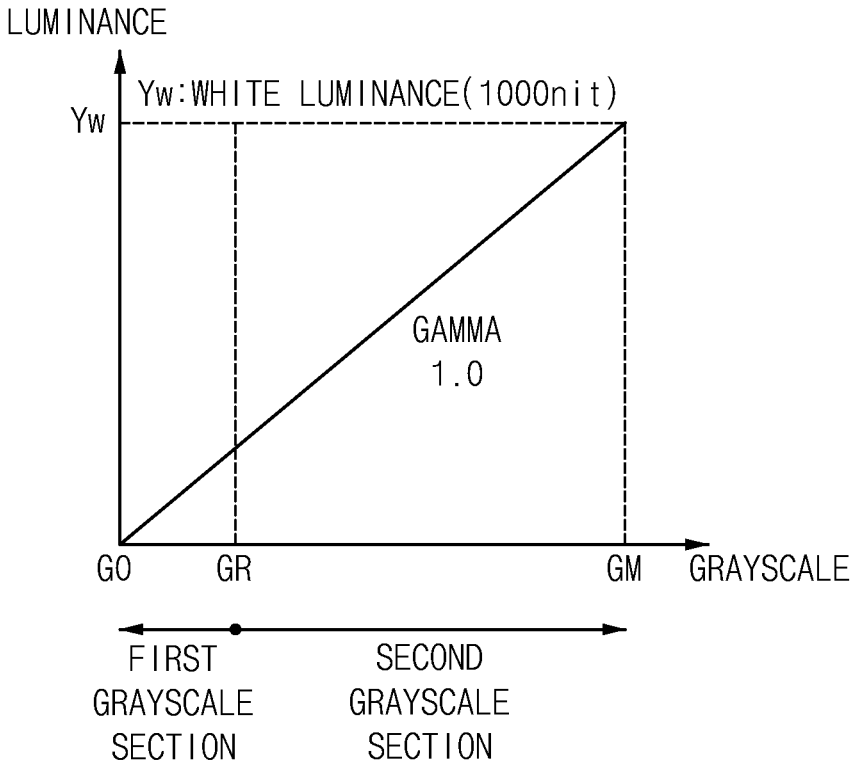
FIG. 3 is a graph for describing an operation of a controller included in the display device in FIG. 1.

FIG. 3 is a graph for describing an operation of the controller 160 included in the display device 100 in FIG. 1. FIG. 3 exemplarily illustrates a case in which the gamma value is 1.0, and a case in which a maximum luminance with respect to the maximum grayscale GM is about 1000 nits based on a white luminance Yw.

Referring to FIG. 3, the controller 160 may drive the display panel 110 with a digital driving method in a first grayscale section in which the input grayscale is greater than or equal to the minimum grayscale G0 and less than or equal to the reference grayscale GR, and may drive the display panel 110 with an analog driving method in a second grayscale section in which the input grayscale is greater than the reference grayscale GR and less than or equal to the maximum grayscale GM. In the digital driving method, the input grayscale may be expressed using only a first data and a second data which are discontinuous. For example, in the digital driving method, the input grayscale may be expressed by temporally and spatially arranging the first data corresponding to the reference grayscale GR and the second data corresponding to the minimum grayscale G0. In the analog driving method, the input grayscale may be expressed by determining an analog data signal corresponding to the input grayscale among continuous analog data signals.

Figure 4:
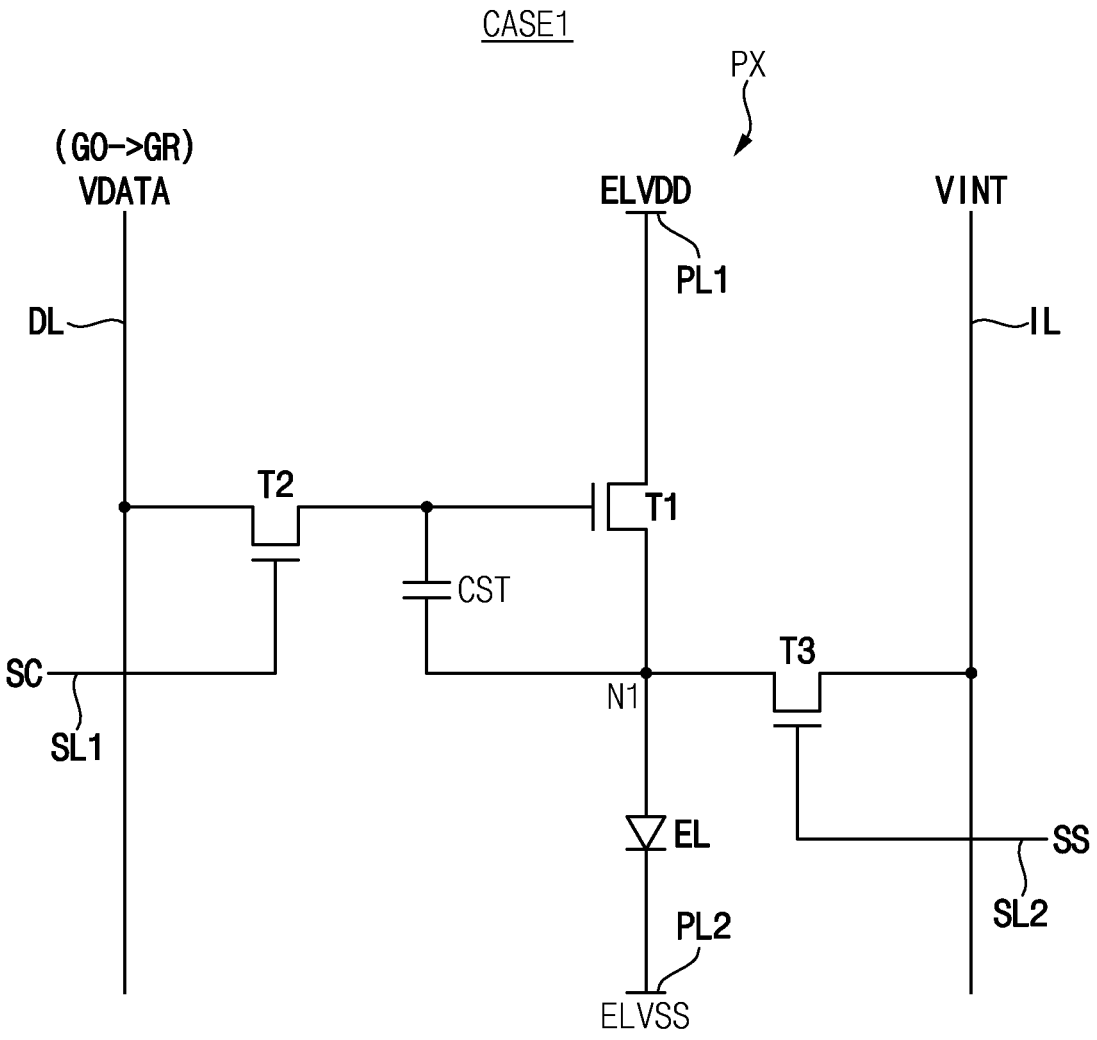
FIG. 4 is a diagram for describing an operation of a pixel in a first case in which a reference grayscale is displayed in the current frame after a minimum grayscale is displayed in the previous frame.
Figure 5:
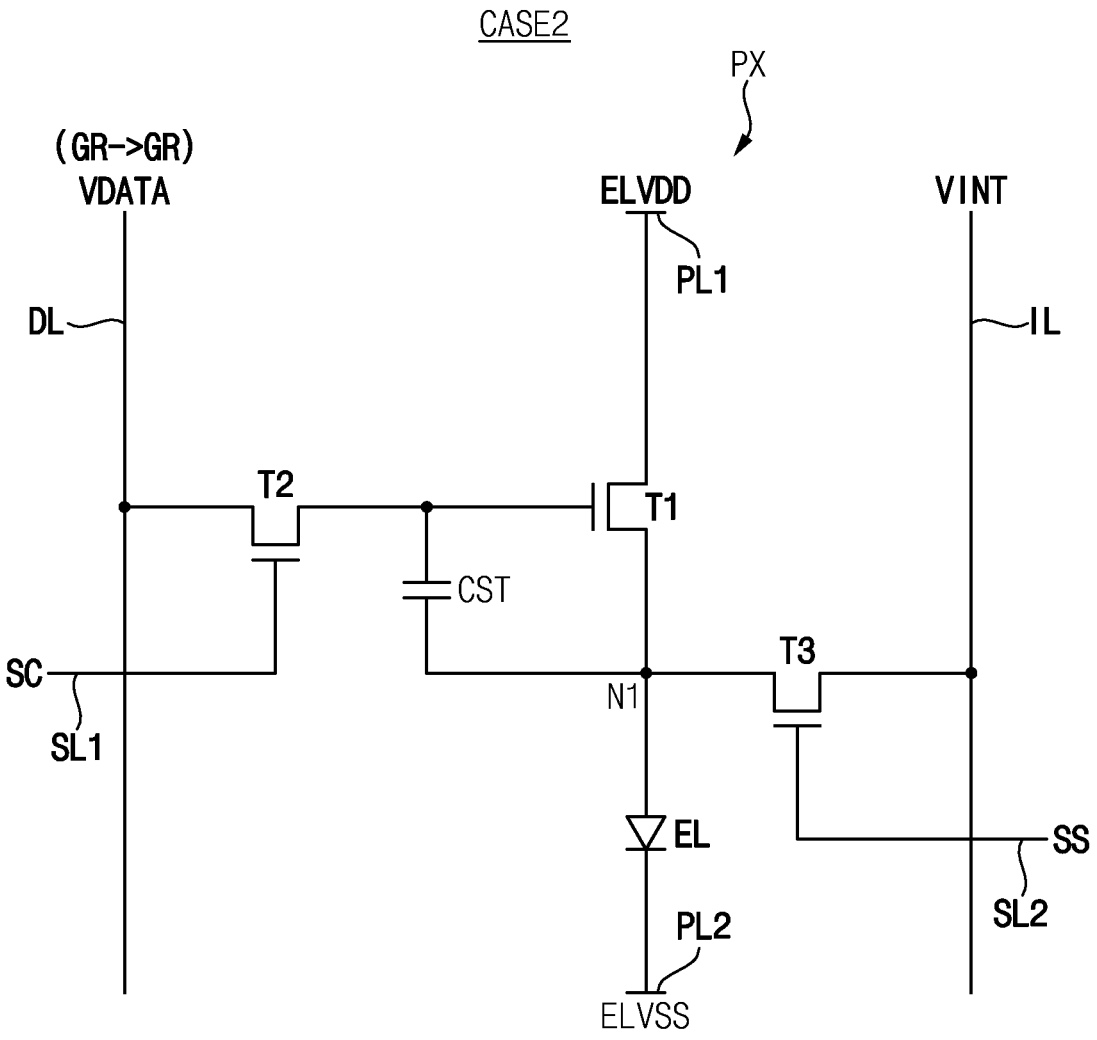
FIG. 5 is a diagram for describing an operation of a pixel in a second case in which a reference grayscale is displayed in the current frame after the reference grayscale is displayed in the previous frame.

FIG. 4 is a diagram for describing an operation of the pixel PX in a first case CASE1 in which a reference grayscale GR is displayed in the current frame after a minimum grayscale is displayed in the previous frame. FIG. 5 is a diagram for describing an operation of the pixel PX in a second case CASE2 in which a reference grayscale GR is displayed in the current frame after the reference grayscale GR is displayed in the previous frame.

Referring to FIGS. 4 and 5, when the pixel PX displays the minimum grayscale G0 based on the data voltage VDATA corresponding to the minimum grayscale G0 in the previous frame (in the first case CASE1), a voltage level of the first electrode of the light emitting element EL in the previous frame may be a floating voltage level lower than a turn-on voltage level of the light emitting element EL. In other words, in the first case CASE1, since the light emitting element EL is turned off in the previous frame, the voltage of the first electrode of the light emitting element EL in the previous frame may be floated. The floating voltage level may be greater than or equal to a voltage level (e.g., about 0 V) of the second power voltage ELVSS, and may be less than the turn-on voltage level (e.g., about 14 V) of the light emitting element EL. For example, in the first case CASE1, the voltage level of the first electrode of the light emitting element EL in the previous frame may be about 6 V.

When the pixel PX displays the reference grayscale GR based on the data voltage VDATA corresponding to the reference grayscale GR in the previous frame (in the second case CASE2), the voltage level of the first electrode of the light emitting element EL in the previous frame may be substantially equal to the turn-on voltage level of the light emitting element EL. For example, in the second case CASE2, the voltage level of the first electrode of the light emitting element EL in the previous frame may be about 14 V. Accordingly, the voltage level of the first electrode of the light emitting element EL in the previous frame of the first case CASE1 may be lower than the voltage level of the first electrode of the light emitting element EL in the previous frame of the second case CASE2.

In the current frame, the initialization voltage VINT may be applied to the first electrode of the light emitting element EL to initialize the first electrode of the light emitting element EL. Since the voltage level of the first electrode of the light emitting element EL in the previous frame of the first case CASE1 is lower than the voltage level of the first electrode of the light emitting element EL in the previous frame of the second case CASE2, a reduction width of the voltage level of the first electrode of the light emitting element EL in the current frame of the first case CASE1 may be less than a reduction width of the voltage level of the first electrode of the light emitting element EL in the current frame of the second case CASE2. For example, when a voltage level of the initialization voltage VINT is about 2 V, the reduction width of the voltage level of the first electrode of the light emitting element EL in the current frame of the first case CASE1 may be about 4 V (=6 V−2 V), and the reduction width of the voltage level of the first electrode of the light emitting element EL in the current frame of the second case CASE2 may be about 12 V (=14 V−2 V). In the first case CASE1, a discharge time of the first electrode of the light emitting element EL may be sufficient because the reduction width of the voltage level of the first electrode of the light emitting element EL is small in the current frame.

However, in the second case CASE2, the discharge time of the first electrode of the light emitting element EL may not be sufficient because the reduction width of the voltage level of the first electrode of the light emitting element EL is large in the current frame. Accordingly, the voltage level of the first electrode of the light emitting element EL initialized in the current frame of the first case CASE1 may be lower than the voltage level of the first electrode of the light emitting element EL initialized in the current frame of the second case CASE2.

After the first electrode of the light emitting element EL is initialized in the current frame, the light emitting element EL may emit light based on a driving current corresponding to a voltage between the gate electrode of the first transistor T1 to which the data voltage VDATA corresponding to the reference grayscale GR is applied and the second electrode of the first transistor T1 (or the first electrode of the light emitting element EL). Since the voltage level of the first electrode of the light emitting element EL initialized in the current frame of the first case CASE1 is lower than the voltage level of the first electrode of the light emitting element EL initialized in the current frame of the second case CASE2, the driving current generated in the current frame of the first case CASE1 may be greater than the driving current generated in the current frame of the second case CASE2. Accordingly, a luminance of the light emitted from the light emitting element EL in the current frame of the first case CASE1 may be higher than a luminance of the light emitted from the light emitting element EL in the current frame of the second case CASE2.

In the digital driving method, the pixel PX may display the reference grayscale GR or the minimum grayscale G0 for each frame. Although the pixel PX displays the reference grayscale GR in the current frame, the luminance of light emitted from the light emitting element EL of the pixel PX in the current frame may vary according to the grayscale of the pixel PX displayed in the previous frame. A luminance of light emitted from the light emitting element EL of the pixel PX which displays the reference grayscale GR in the current frame when the pixel PX displays the minimum grayscale G0 in the previous frame (in the first case CASE1) may be higher than a luminance of light emitted from the light emitting element EL of the pixel PX which displays the reference grayscale GR in the current frame when the pixel PX displays the reference grayscale GR in the previous frame (in the second case CASE2).

When a first pixel continuously displays the reference grayscale GR in frames and a second pixel adjacent to the first pixel alternately displays the minimum grayscale G0 and the reference grayscale GR in the frames, although the first and second pixels display the reference grayscale GR in the current frame, a luminance of light emitted from the light emitting element EL of the second pixel may be higher than a luminance of light emitted from the light emitting element EL of the first pixel. The difference in luminance between the first and second pixels may be recognized as unevenness of the display device 100.

Figure 6:
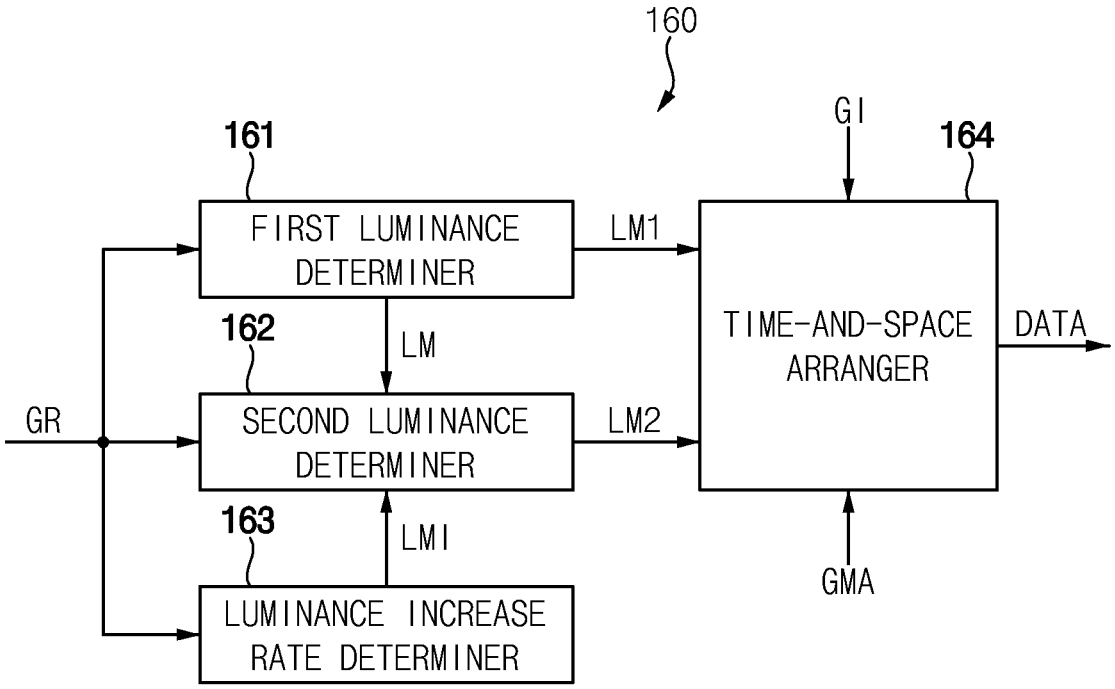
FIG. 6 is a block diagram illustrating a controller according to an embodiment.

FIG. 6 is a block diagram illustrating a controller 160 according to an embodiment.

Referring to FIG. 6, the controller 160 may include a first luminance determiner 161, a second luminance determiner 162, a luminance increase rate determiner 163, and a time-and-space arranger 164 to drive the display panel 110 with a digital driving method.

The first luminance determiner 161 may determine first luminances LM1 with respect to the reference grayscale GR in a second frame after a first frame when the reference grayscale GR is displayed in the second frame after the reference grayscale GR is displayed in the first frame. The first luminance determiner 161 may include a first look-up table ("LUT") that stores luminances LM with respect to all grayscales in the second frame when the same grayscale is displayed in the first frame and the second frame. The first luminance determiner 161 may provide the luminances LM stored in the first look-up table to the second luminance determiner 162. The first luminance determiner 161 may receive the reference grayscale GR, may generate the first luminances LM1 that are luminances with respect to the reference grayscale GR from the first look-up table, and may provide the first luminances LM1 to the time-and-space arranger 164.

The second luminance determiner 162 may determine second luminances LM2 with respect to the reference grayscale GR in the second frame when the reference grayscale GR is displayed in the second frame after the minimum grayscale G0 is displayed in the first frame. The second luminance determiner 162 may include a second look-up table that stores luminances LM with respect to remaining grayscales except for the minimum grayscale G0 among all grayscales in the second frame when the minimum grayscale G0 is displayed in the first frame and the remaining grayscales are displayed in the second frame. The luminances LM stored in the second look-up table may be generated based on the luminances LM provided from the first luminance determiner 161 and a luminance increase rate LMI of the reference grayscale GR to the minimum grayscale G0 provided from the luminance increase rate determiner 163. The second luminance determiner 162 may receive the reference grayscale GR, may generate the second luminances LM2 that are luminances with respect to the reference grayscale GR from the second look-up table, and may provide the second luminances LM2 to the time-and-space arranger 164.

The luminance increase rate determiner 163 may determine the luminance increase rate LMI of the reference grayscale GR to the minimum grayscale G0. The luminance increase rate determiner 163 may include a third look-up table that stores luminance increase rates of all grayscales to the minimum grayscale G0. The luminance increase rate determiner 163 may receive the reference grayscale GR, may generate the luminance increase rate LMI of the reference grayscale GR to the minimum grayscale G0 from the third look-up table, and may provide the luminance increase rate LMI to the second luminance determiner 162.

The time-and-space arranger 164 may generate the data signal DATA corresponding to the input grayscale GI based on the input grayscale GI, the gamma value GMA, the first luminances LMI, and the second luminances LM2. The input grayscale GI may be a grayscale within a first grayscale section that is greater than or equal to the minimum grayscale G0 and less than or equal to the reference grayscale GR. The time-and-space arranger 164 may temporally and spatially arrange the first data corresponding to the reference grayscale GR and the second data corresponding to the minimum grayscale G0 to generate the data signal DATA corresponding to the input grayscale GI.

Hereinafter, a digital driving method when the reference grayscale GR is 9 grayscale will exemplarily described with reference to FIGS. 7 to 10.

Figure 7:
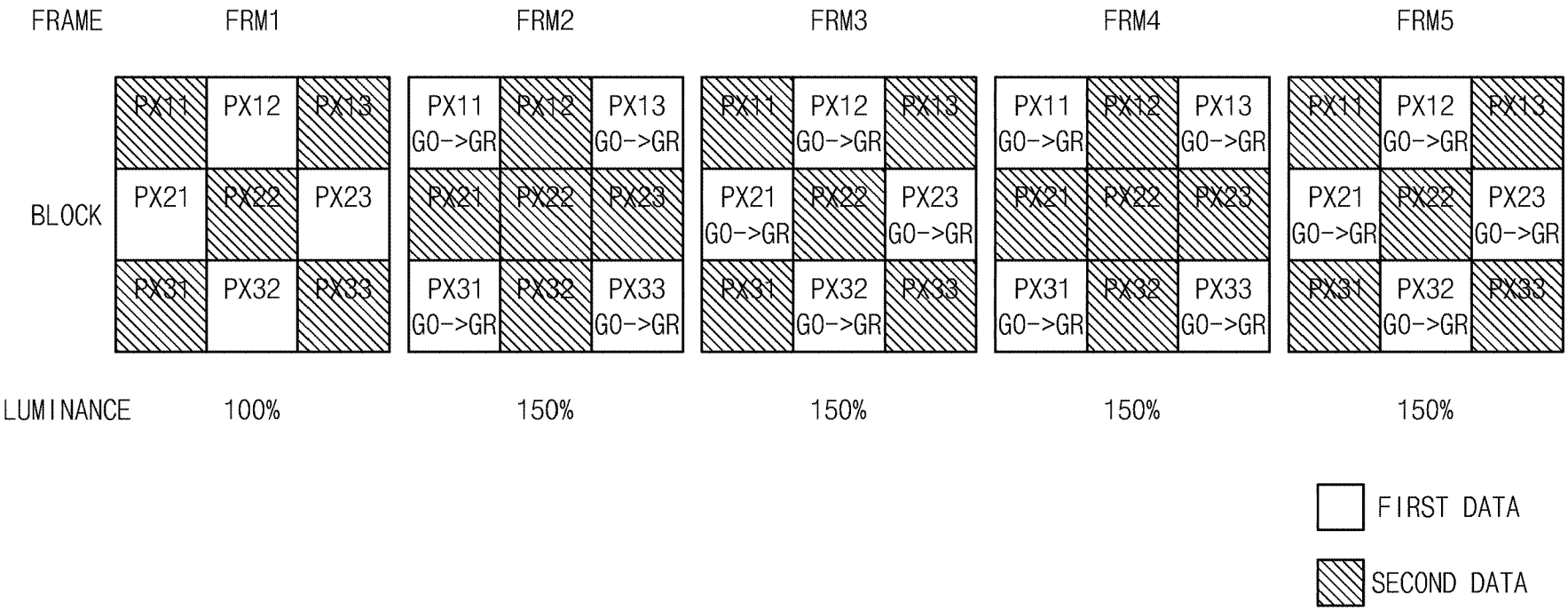
FIG. 7 is a diagram illustrating a block representing four grayscale pixels in first to fifth frames according to a comparative example.
Figure 8:
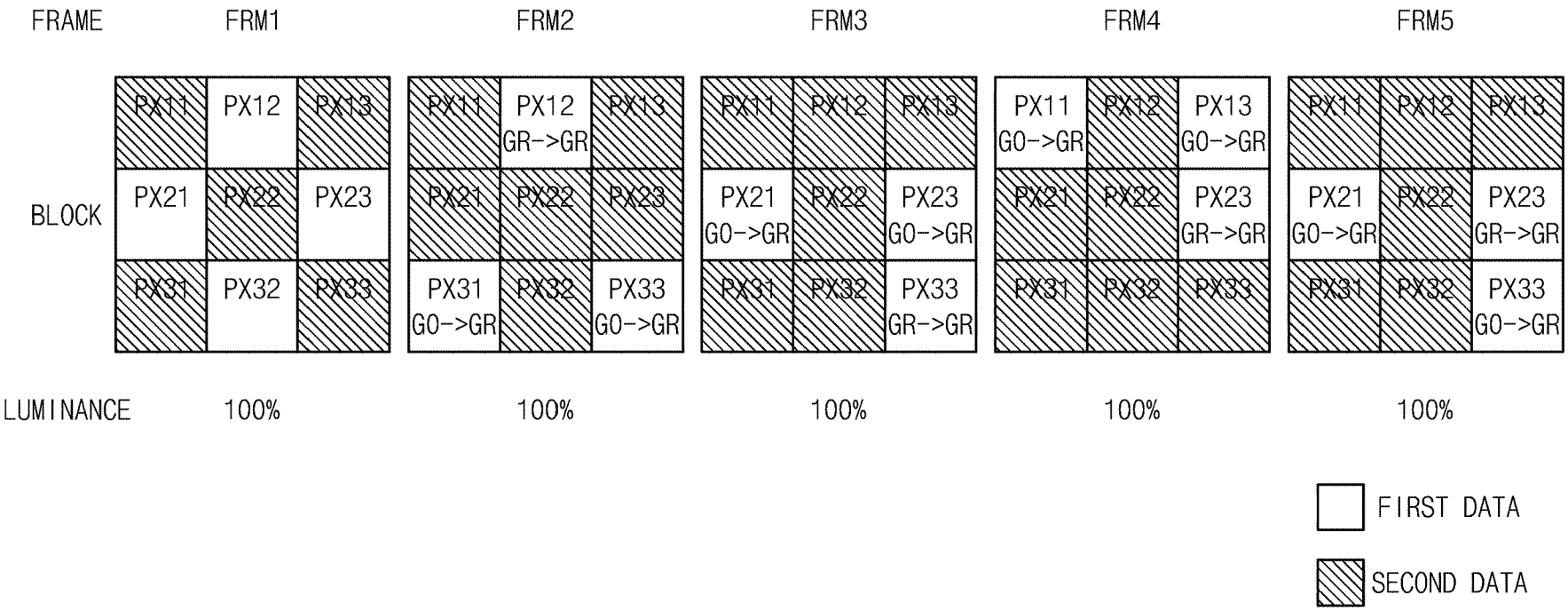
FIG. 8 is a diagram illustrating a block representing four grayscale pixels in first to fifth frames according to an embodiment.
Figure 9:
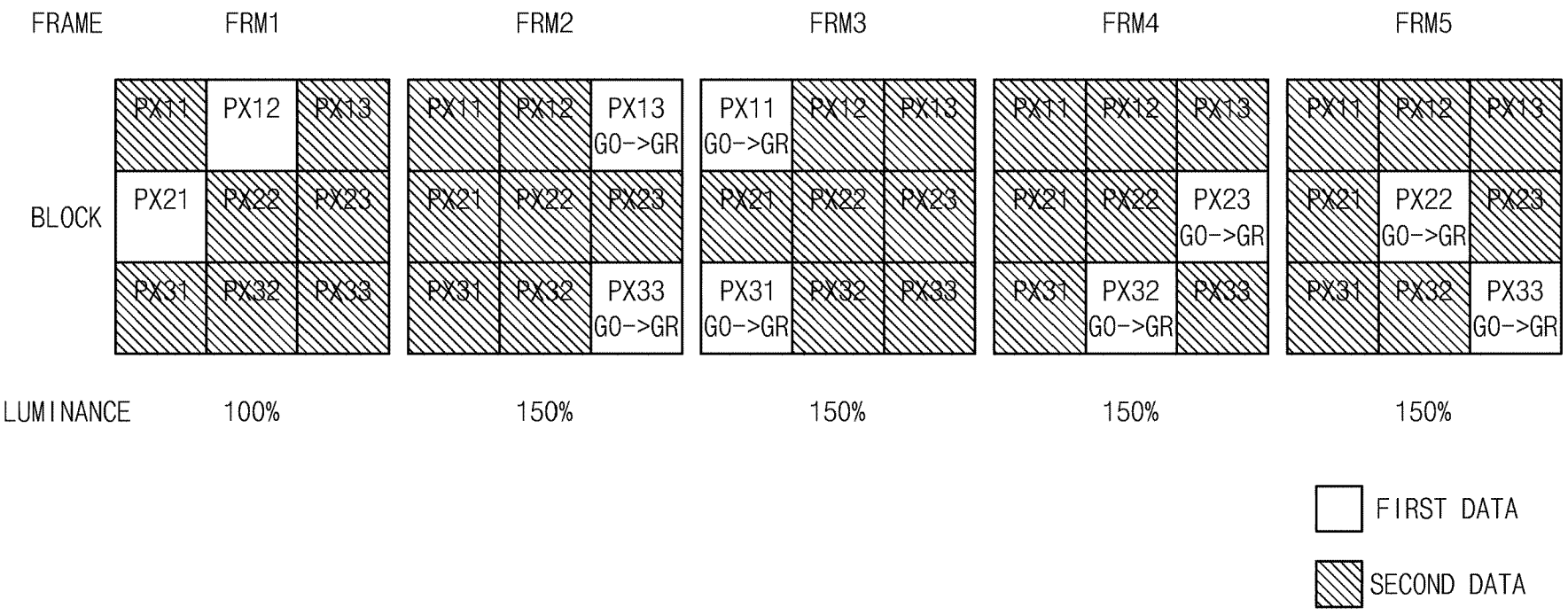
FIG. 9 is a diagram illustrating a block representing two grayscale pixels in first to fifth frames according to a comparative example.
Figure 10:
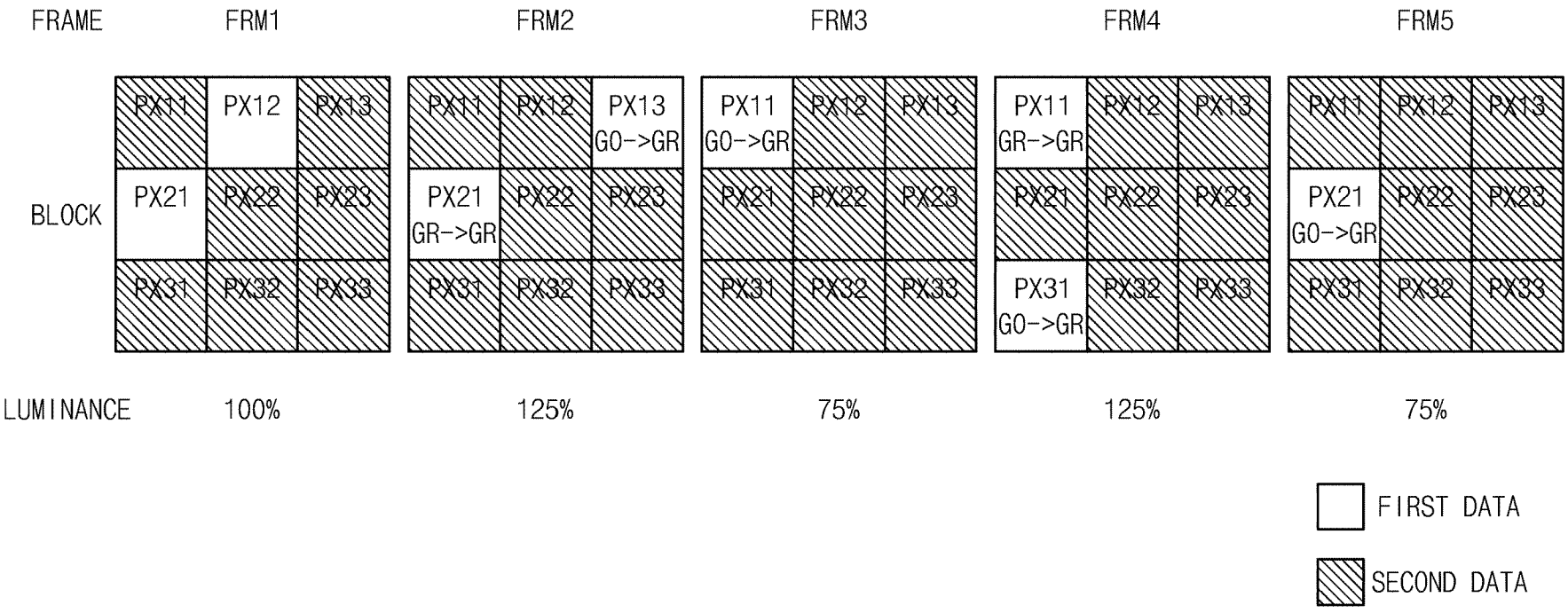
FIG. 10 is a diagram illustrating a block representing two grayscale pixels in first to fifth frames according to an embodiment.

FIG. 7 is a diagram illustrating a block representing four grayscale pixels in first to fifth frames FRM1-FRM5 according to a comparative example. FIG. 8 is a diagram illustrating a block representing four grayscale pixels in first to fifth frames FRM1-FRM5 according to an embodiment. FIG. 9 is a diagram illustrating a block representing two grayscale pixels in first to fifth frames FRM1-FRM5 according to a comparative example. FIG. 10 is a diagram illustrating a block representing two grayscale pixels in first to fifth frames FRM1-FRM5 according to an embodiment. FIGS. 7, 8, 9, and 10 exemplarily illustrate that one block includes first to ninth pixels PX11, PX12, PX13, PX21, PX22, PX23, PX31, PX32, and PX33.

Referring to FIGS. 7 and 9, in the comparative example, the number of pixels to which the first data corresponding to the reference grayscale GR is inputted in the current frame may be equal to the number of pixels to which the first data is inputted in the previous frame. The previous frame may be the first frame FRM1 when the current frame is the second frame FRM2, and the previous frame may be the fourth frame FRM4 when the current frame is the fifth frame FRM5. The second data corresponding to the minimum grayscale G0 may be inputted in the previous frame to pixels to which the first data is inputted in the current frame. As described above, since the luminance of the pixel PX displaying the reference grayscale GR in the current frame after displaying the minimum grayscale G0 in the previous frame is higher than the luminance of the pixel PX displaying the reference grayscale GR in the current frame after displaying the reference grayscale GR in the previous frame, in the comparative example, a luminance of the block in the second to fifth frames FRM2-FRM5 may be greater than a luminance of the block in the first frame FRM1. For example, when the luminance of the pixel PX displaying the reference grayscale GR in the current frame after displaying the minimum grayscale G0 in the previous frame is about 150% of the luminance of the pixel PX displaying the reference grayscale GR in the current frame after displaying the reference grayscale GR in the previous frame, the luminance of the block in the second to fifth frames FRM2-FRM5 may be about 150% of the luminance of the block in the first frame FRM1.

Referring to FIG. 8, in an embodiment, the number of pixels PX12, PX31, and PX33 to which the first data corresponding to the reference grayscale GR is inputted in the second frame FRM2, the number of pixels PX21, PX23, and PX33 to which the first data is inputted in the third frame FRM3, the number of pixels PX11, PX13, and PX23 to which the first data is inputted in the fourth frame FRM4, and the number of pixels PX21, PX23, and PX33 to which the first data is inputted in the fifth frame FRM5 may be less than or equal to the number of pixels PX21, PX21, PX23, and PX32 to which the first data is inputted in the first frame FRM1. The first data may be inputted in the current frame to at least one of pixels to which the second data corresponding to the minimum grayscale G0 is inputted in the previous frame. The current frame may be the second frame FRM2 when the previous frame is the first frame FRM1, and the current frame may be the fifth frame FRM5 when the previous frame is the fourth frame FRM4. For example, the first data may be inputted in the second frame FRM2 to at least one PX31 and PX33 of the pixels PX11, PX13, PX22, PX31, and PX33 to which the second data is inputted in the first frame FRM1. FIG. 8 exemplarily illustrates that the first data is inputted to the second pixel PX12, the fourth pixel PX21, the sixth pixel PX23, and the eighth pixel PX32 in the first frame FRM1, and the first data is inputted to the second pixel PX12, the seventh pixel PX31, and the ninth pixel PX33 in the second frame FRM2. For example, when the luminance of the pixel PX displaying the reference grayscale GR in the current frame after displaying the minimum grayscale G0 in the previous frame is about 150% of the luminance of the pixel PX displaying the reference grayscale GR in the current frame after displaying the reference grayscale GR in the previous frame, the luminance of the block in the second frame FRM2 may be substantially equal to the luminance of the block in the first frame FRM1.

The number of pixels PX21, PX23, and PX33 to which the first data is inputted in the third frame FRM3, the number of pixels PX11, PX13, and PX23 to which the first data is inputted in the fourth frame FRM4, and the number of pixels PX21, PX23, and PX33 to which the first data is inputted in the fifth frame FRM5 may be equal to the number of pixels PX12, PX31, and PX33 to which the first data is inputted in the second frame FRM2. The luminance of the block in the second frame FRM2, the luminance of the block in the third frame FRM3, the luminance of the block in the fourth frame FRM4, and the luminance of the block in the fifth frame FRM5 may be substantially equal to the luminance of the block in the first frame FRM1.

In the present embodiment, the controller 160 may temporally and spatially arrange the first data corresponding to the reference grayscale GR and the second data corresponding to the minimum grayscale G0 to the block in each of the second to fifth frames FRM2-FRM5 such that the luminance of the block in each of the second to fifth frames FRM2-FRM5 is equal to the luminance of the block in the first frame FRM1, so that the luminance with respect to the input grayscale GI may be accurately displayed.

Referring to FIG. 10, in an embodiment, the number of pixels PX13 and PX21 to which the first data corresponding to the reference grayscale GR is inputted in the second frame FRM2, the number of pixels PX11 to which the first data is inputted in the third frame FRM3, the number of pixels PX11 and PX31 to which the first data is inputted in the fourth frame FRM4, and the number of pixels PX21 to which the first data is inputted in the fifth frame FRM5 may be less than or equal to the number of pixels PX12 and PX21 to which the first data is inputted in the first frame FRM1. The first data may be inputted in the current frame to at least one of pixels to which the second data corresponding to the minimum grayscale G0 is inputted in the previous frame. The current frame may be the second frame FRM2 when the previous frame is the first frame FRM1, and the current frame may be the fifth frame FRM5 when the previous frame is the fourth frame FRM4. For example, the first data may be inputted in the second frame FRM2 to at least one PX13 of pixels PX11, PX13, PX22, PX23, PX31, PX32 and PX33 to which the second data is inputted in the first frame FRM1. FIG. 10 exemplarily illustrates that the first data is inputted to the second pixel PX12 and the fourth pixel PX21 in the first frame FRM1, and the first data is inputted to the third pixel PX13 and the fourth pixel PX21 in the second frame FRM2. For example, when the luminance of the pixel PX displaying the reference grayscale GR in the current frame after displaying the minimum grayscale G0 in the previous frame is about 150% of the luminance of the pixel PX displaying the reference grayscale GR in the current frame after displaying the reference grayscale GR in the previous frame, the luminance of the block in the second frame FRM2 may be about 150% of the luminance of the block in the first frame FRM1.

The number of pixels PX11 to which the first data is inputted in the third frame FRM3 may be different from the number of pixels PX31 and PX21 to which the first data is inputted in the second frame FRM2. FIG. 10 exemplarily illustrates that the first data is inputted to the first pixel PX11 in the third frame FRM3. For example, when the luminance of the pixel PX displaying the reference grayscale GR in the current frame after displaying the minimum grayscale G0 in the previous frame is about 150% of the luminance of the pixel PX displaying the reference grayscale GR in the current frame after displaying the reference grayscale GR in the previous frame, the luminance of the block in the third frame FRM3 may be about 75% of the luminance of the block in the first frame FRM1. The average of the luminance of the block in the second frame FRM2 and the luminance of the block in the third frame FRM3 may be substantially equal to the luminance of the block in the first frame FRM1.

The operation of the controller 160 is described above with reference to FIG. 10 focusing on the second frame FRM2 and the third frame FRM3, however, the operation of the controller 160 in the fourth frame FRM4 and the fifth frame FRM5 may be substantially the same as or similar to the operation of the controller 160 in the second frame FRM2 and the third frame FRM3.

In the present embodiment, the controller 160 may temporally and spatially arrange the first data corresponding to the reference grayscale GR and the second data corresponding to the minimum grayscale G0 to the block in each of the second to fifth frames FRM2-FRM5 such that the average luminance of the block in the second to fifth frames FRM2-FRM5 is equal to the luminance of the block in the first frame FRM1, so that the luminance with respect to the input grayscale GI may be accurately displayed.

Figure 11:
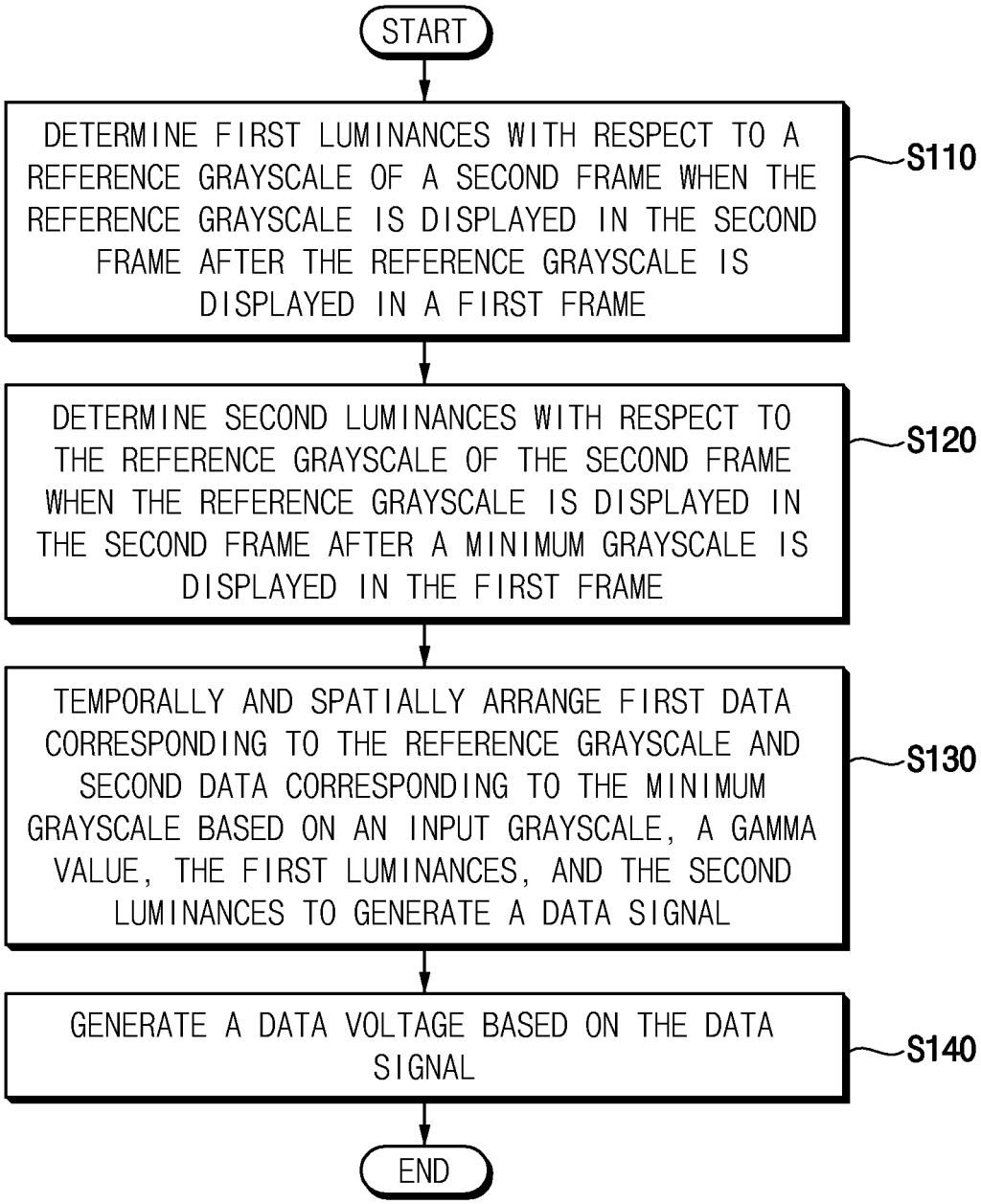
FIG. 11 is a flowchart illustrating a method of driving a display device according to an embodiment.

FIG. 11 is a flowchart illustrating a method of driving a display device 100 according to an embodiment.

Referring to FIGS. 6 and 11, the first luminance determiner 161 of the controller 160 may determine the first luminances LM1 with respect to the reference grayscale GR in a second frame after a first frame when the reference grayscale GR is displayed in the second frame after the reference grayscale GR is displayed in the first frame (S110). The first luminance determiner 161 may generate the first luminances LM1 that are luminances with respect to the reference grayscale GR from the first look-up table storing luminances LM with respect to all grayscales in the second frame when the same grayscale is displayed in the first frame and the second frame.

Then, the second luminance determiner 162 of the controller 160 may determine the second luminances LM2 with respect to the reference grayscale GR in the second frame when the reference grayscale GR is displayed in the second frame after the minimum grayscale G0 is displayed in the first frame (S120). The second luminance determiner 162 may generate the second luminances LM2 that are luminances with respect to the reference grayscale GR from the second look-up table storing luminances LM with respect to remaining grayscales except for the minimum grayscale G0 among all grayscales in the second frame when the minimum grayscale G0 is displayed in the first frame and the remaining grayscales are displayed in the second frame.

Then, the time-and-space arranger 164 of the controller 160 may generate the data signal DATA corresponding to the input grayscale GI based on the input grayscale GI, the gamma value GMA, the first luminances LM1, and the second luminances LM2 (S130). The time-and-space arranger 164 may temporally and spatially arrange the first data corresponding to the reference grayscale GR and the second data corresponding to the minimum grayscale G0 to generate the data signal DATA corresponding to the input grayscale GI.

The time-and-space arranger 164 may temporally and spatially arrange the first data corresponding to the reference grayscale GR and the second data corresponding to the minimum grayscale G0 in frames after the first frame such that the average luminance of the block in the frames after the first frame is equal to the luminance of the block in the first frame, so that the luminance with respect to the input grayscale GI may be accurately displayed.

The number of pixels to which the first data is inputted in the frames after the first frame may be less than or equal to the number of pixels to which the first data is inputted in the first frame. For example, the number of pixels to which first data is inputted in the second frame and the number of pixels to which first data is inputted in a third frame after the second frame may be less than or equal to the number of pixels to which first data is inputted in the first frame.

The first data may be inputted in the current frame to at least one of pixels to which the second data is inputted in the previous frame. For example, the first data may be inputted in the second frame to at least one of pixels to which the second data is inputted in the first frame, and the first data may be inputted in the third frame to at least one of pixels to which the second data is inputted in the second frame.

Referring to FIGS. 1 and 11, then, the data driver 130 may generate the data voltage VDATA based on the data signal DATA (S140).

Figure 12:
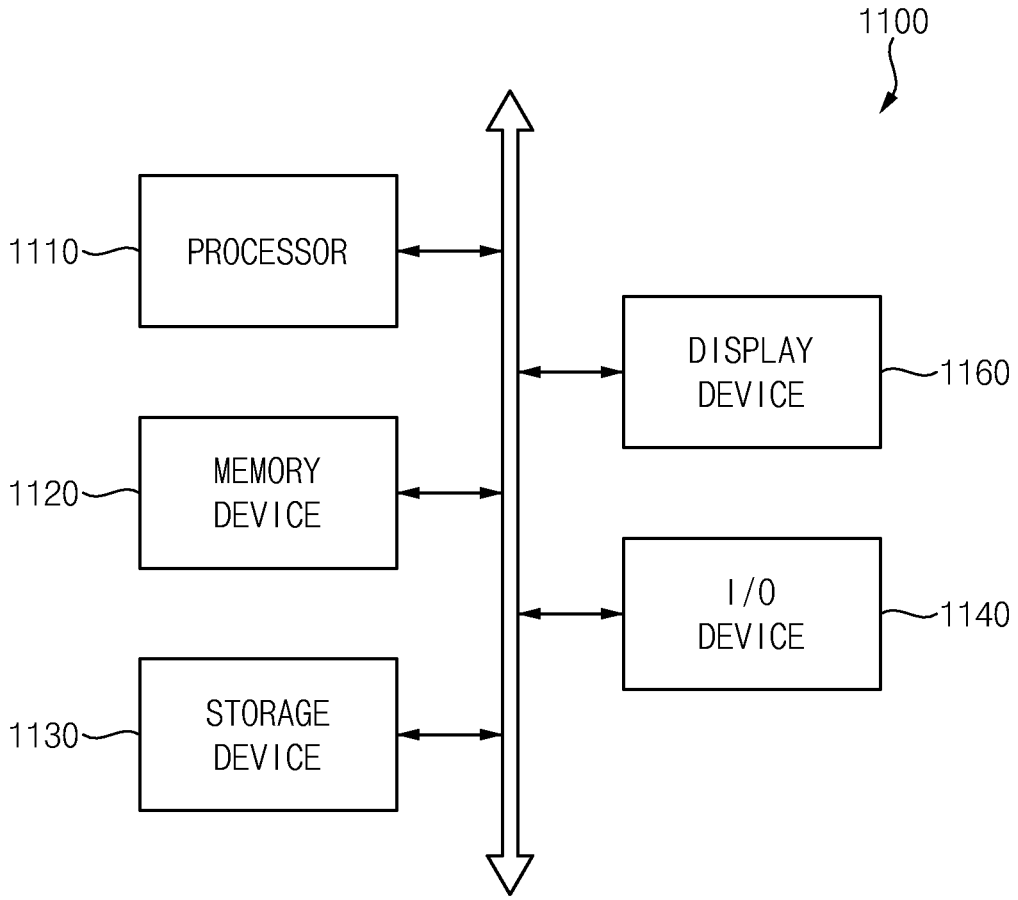
FIG. 12 is a block diagram illustrating an electronic apparatus including a display device according to an embodiment.

FIG. 12 is a block diagram illustrating an electronic apparatus 1100 including a display device 1160 according to an embodiment.

Referring to FIG. 12, the electronic apparatus 1100 may include a processor 1110, a memory device 1120, a storage device 1130, an input/output ("I/O") device 1140, and a display device 1160. The electronic apparatus 1100 may further include a plurality of ports for communicating with a video card, a sound card, a memory card, a universal serial bus ("USB") device, etc.

The processor 1110 may perform particular calculations or tasks. In an embodiment, the processor 1110 may be a microprocessor, a central processing unit ("CPU"), or the like. The processor 1110 may be coupled to other components via an address bus, a control bus, a data bus, or the like. In an embodiment, the processor 1110 may be coupled to an extended bus such as a peripheral component interconnection ("PCI") bus.

The memory device 1120 may store data for operations of the electronic apparatus 1100. In an embodiment, the memory device 1120 may include a non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or a volatile memory device such as a dynamic random access memory ("DRAM") device, a static random access memory ("SRAM") device, a mobile DRAM device, etc.

The storage device 1130 may include a solid state drive ("SSD") device, a hard disk drive ("HDD") device, a CD-ROM device, or the like. The I/O device 1140 may include an input device such as a keyboard, a keypad, a touchpad, a touch-screen, a mouse device, etc., and an output device such as a speaker, a printer, etc. The display device 1160 may be coupled to other components via the buses or other communication links.

In the display device 1160, in the first grayscale section, the first data corresponding to the reference grayscale and the second data corresponding to the minimum grayscale may be temporally and spatially arranged based on the first luminances, which indicates luminances with respect to the reference grayscale when the reference grayscale is displayed after the reference grayscale is displayed, and the second luminances, which indicates luminances with respect to the reference grayscale when the reference grayscale is displayed after the minimum grayscale is displayed, to generate the data signal, so that a luminance with respect to an input grayscale may be accurately displayed.

The display device according to the embodiments may be applied to a display device included in a computer, a notebook, a mobile phone, a smart phone, a smart pad, a PMP, a PDA, an MP3 player, or the like.

Although embodiments of the present inventive concepts have been described, various modifications and similar arrangements of such embodiments will be apparent to a person of ordinary skill in the art. Accordingly, the inventive concepts are not limited to such embodiments, but rather to the scope and spirit of the appended claims.

What is claimed is:

1. A display device, comprising:

a display panel including at least one block including a plurality of pixels;

a controller configured to:

determine first luminances with respect to a reference grayscale in a second frame after a first frame when the reference grayscale is displayed in the second frame after the reference grayscale is displayed in the first frame;

determine second luminances with respect to the reference grayscale in the second frame when the reference grayscale is displayed in the second frame after a minimum grayscale is displayed in the first frame;

temporally and spatially arrange first data corresponding to the reference grayscale and second data corresponding to the minimum grayscale based on an input grayscale, a gamma value, the first luminances, and the second luminances to generate a data signal;

drive the display panel with a digital driving method using the first data and the second data in a first grayscale section less than or equal to the reference grayscale; and drive the display panel with an analog driving method in a second grayscale section greater than the reference grayscale; and a data driver configured to generate a data voltage based on the data signal and output the data voltage to the display panel.

2. The display device of claim 1, wherein a number of the pixels to which the first data is inputted in the second frame is less than or equal to a number of the pixels to which the first data is inputted in the first frame.

3. The display device of claim 2, wherein the first data is inputted in the second frame to at least one of the pixels to which the second data is inputted in the first frame.

4. The display device of claim 1, wherein a number of the pixels to which the first data is inputted in a third frame after the second frame is equal to a number of the pixels to which the first data is inputted in the second frame.

5. The display device of claim 4, wherein each of a luminance of the block in the second frame and a luminance of the block in the third frame is equal to a luminance of the block in the first frame.

6. The display device of claim 1, wherein a number of the pixels to which the first data is inputted in a third frame after the second frame is different from a number of the pixels to which the first data is inputted in the second frame.

7. The display device of claim 6, wherein an average of a luminance of the block in the second frame and a luminance of the block in the third frame is equal to a luminance of the block in the first frame.

8. The display device of claim 1, further comprising:

a scan driver configured to output a first scan signal and a second scan signal to the display panel.

9. The display device of claim 8, wherein each of the pixels includes:

a first transistor connected between a first power line transmitting a first power voltage and a first node;

a second transistor connected between a data line transmitting the data voltage and a gate electrode of the first transistor, and including a gate electrode connected to a first scan line transmitting the first scan signal;

a third transistor connected between an initialization line transmitting an initialization voltage and the first node, and including a gate electrode connected to a second scan line transmitting the second scan signal;

a storage capacitor connected between the gate electrode of the first transistor and the first node; and a light emitting element connected between the first node and a second power line transmitting a second power voltage.

10. A controller, comprising:

a first luminance determiner configured to determine first luminances with respect to a reference grayscale in a second frame after a first frame when the reference grayscale is displayed in the second frame after the reference grayscale is displayed in the first frame;

a second luminance determiner configured to determine second luminances with respect to the reference grayscale in the second frame when the reference grayscale is displayed in the second frame after a minimum grayscale is displayed in the first frame; and a time-and-space arranger configured to temporally and spatially arrange first data corresponding to the reference grayscale and second data corresponding to the minimum grayscale based on an input grayscale, a gamma value, the first luminances, and the second luminances, wherein the controller is configured to:

drive a display panel including at least one block including a plurality of pixels with a digital driving method using the first data and the second data in a first grayscale section less than or equal to the reference grayscale; and drive the display panel with an analog driving method in a second grayscale section greater than the reference grayscale.

11. The controller of claim 10, wherein a number of the pixels to which the first data is inputted in the second frame is less than or equal to a number of the pixels to which the first data is inputted in the first frame.

12. The controller of claim 11, wherein the first data is inputted in the second frame to at least one of the pixels to which the second data is inputted in the first frame.

13. The controller of claim 10, wherein a number of the pixels to which the first data is inputted in a third frame after the second frame is equal to a number of the pixels to which the first data is inputted in the second frame.

14. The controller of claim 13, wherein each of a luminance of the block in the second frame and a luminance of the block in the third frame is equal to a luminance of the block in the first frame.

15. The controller of claim 10, wherein a number of the pixels to which the first data is inputted in a third frame after the second frame is different from a number of the pixels to which the first data is inputted in the second frame.

16. The controller of claim 15, wherein an average of a luminance of the block in the second frame and a luminance of the block in the third frame is equal to a luminance of the block in the first frame.

17. The controller of claim 10, further comprising:

a luminance increase rate determiner configured to store luminance increase rates of grayscales to the minimum grayscale.

18. The controller of claim 17, wherein each of the first luminance determiner, the second luminance determiner, and the luminance increase rate determiner includes a look-up table.

19. A method of driving a display device including at least one block including a plurality of pixels, the method comprising:

determining first luminances with respect to a reference grayscale in a second frame after a first frame when the reference grayscale is displayed in the second frame after the reference grayscale is displayed in the first frame;

determining second luminances with respect to the reference grayscale in the second frame when the reference grayscale is displayed in the second frame after a minimum grayscale is displayed in the first frame;

temporally and spatially arranging first data corresponding to the reference grayscale and second data corresponding to the minimum grayscale based on an input grayscale, a gamma value, the first luminances, and the second luminances to generate a data signal; and generating a data voltage based on the data signal.

20. The method of claim 19, wherein a number of the pixels to which the first data is inputted in the second frame is less than or equal to a number of the pixels to which the first data is inputted in the first frame.

* * * * *